US005938201A

United States Patent [19]

Gulliver

[11] Patent Number: 5,938,201

[45] Date of Patent: Aug. 17, 1999

[54] MULTIPLICATION TABLES CHECKERS GAMES

[76] Inventor: Daniel Gulliver, 627 Pierce St., Philadelphia, Pa. 19148

[21] Appl. No.: 09/084,477

[22] Filed: May 22, 1998

[51] Int. Cl.[6] ..... A63F 3/02

[52] U.S. Cl. ..... 273/261

[58] Field of Search ..... 273/260, 261

[56] References Cited

U.S. PATENT DOCUMENTS

| | | | |
|---|---|---|---|
| 682,052 | 9/1901 | Felter | 273/261 |
| 4,037,843 | 7/1977 | Hoffman | 273/261 |
| 4,289,314 | 9/1981 | Berlino | 273/260 |
| 4,364,568 | 12/1982 | Tracy | 273/261 X |
| 5,116,062 | 5/1992 | Johnson | 273/260 |
| 5,312,112 | 5/1994 | Cohen | 273/261 X |
| 5,511,793 | 4/1996 | Watt | 273/261 X |
| 5,570,887 | 11/1996 | Christie, Jr. | 273/261 |

*Primary Examiner*—William E. Stoll
*Attorney, Agent, or Firm*—Susan B. Evans; Evans & Burrell

[57] ABSTRACT

Disclosed herein is a checkers board game for two players which includes a checker game board consisting of twelve rows of twelve alternate playing and non-playing squares of contrasting colors. Each board square is marked with two numbers, one number facing each of the two players. Each player is provided with one set of 30 game pieces including one piece that is marked with the number 12. The only difference between the game pieces of each player is their color so as to distinguish the pieces of one player from those of the other. The game is played in a conventional matter somewhat like the traditional game of checkers with the players moving forward, jumping, removing the jumped piece and becoming a king. Points are scored and reported on a score card. The score card is configured similar to the game board but every other number is omitted. A player scores his/her card with the number indicated on a game square when said player jumps his/her opponent and lands on a playing square until all the blank squares on the score card are filled in. A Super Win is attained when a player is able to move his/her 12 Piece to capture the 12/12 or 1/144 playing square of the opponent.

2 Claims, 5 Drawing Sheets

40 44 42

| | | | | | | | | | | | |
|---|---|---|---|---|---|---|---|---|---|---|---|
| 1 | | 3 | | 5 | | 7 | | 9 | | 11 | |
| | 4 | | 8 | | 12 | | 16 | | 20 | | 24 |
| 3 | | 9 | | 15 | | 21 | | 27 | | 33 | |
| | 8 | | 16 | | 24 | | 32 | | 40 | | 48 |
| 5 | | 15 | | 25 | | 35 | | 45 | | 55 | |
| | 12 | | 24 | | 36 | | 48 | | 60 | | 72 |
| 7 | | 21 | | 35 | | 49 | | 63 | | 77 | |
| | 16 | | 32 | | 48 | | 64 | | 80 | | 96 |
| 9 | | 27 | | 45 | | 63 | | 81 | | 99 | |
| | 20 | | 40 | | 60 | | 80 | | 100 | | 120 |
| 11 | | 33 | | 55 | | 77 | | 99 | | 121 | |
| | 24 | | 48 | | 72 | | 96 | | 120 | | 144 |

Fig 3

MULTIPLICATION TABLES CHECKERS GAMES

BACKGROUND

The present invention relates generally to a multiplication checkers game apparatus for play by two people. This game combines the general tactics and game playing skills of checkers with numerical manipulations of the multiplication tables from 1–12.

In today's society the game of checkers is well known and played internationally. Throughout the years there have been numerous variations and various methods of play. The play of the traditional checkers game involves two players moving game pieces on a firm playing surface divided alternately between differently colored squares, with all play being conducted on spaces of one color. The players sit on opposite sides of the board and alternately move their pieces diagonally in a forward direction. Upon reaching the last row on the board, pieces are crowned becoming "kings". Kings may move both backwards and forwards diagonally. The object in the traditional game is to eliminate opponent's game pieces from play by jumping them.

The present invention adds a new dimension to this old game. The present invention has a square game board of 144 playing squares each square having two numerals one numeral facing each player. The present invention provides both a unique playing strategy and provides an educational stimulus. It also provides for a Super Win opportunity for a player that can move his/her 12 Piece across the game board and capture the 12/12 or 1/144 playing square of the opponent.

A further component of the game is the game pieces also referred to as the checkers. There are sixty game pieces, thirty for each player. Two of the checkers (one for each player) is labeled 12 and referred to as a 12 Piece. They are placed on the 12/12 or 1/144 game square of the players at the beginning of each game and can be moved as a king or a crowned playing piece.

Various checker games are known in the art. One such patent discloses a checker game with the game pieces representing mathematical functions for addition, subtraction, multiplication and division. Points are scored for winning the game and for performing the mathematical functions. See U.S. Pat. No. 5,116,062 (Palmer M. Johnson).

This prior art does not disclose the instant invention.

SUMMARY OF THE INVENTION

The present invention provides a checker board game apparatus for play by two players comprising:

- a game board divided into 12 rows of 12 alternate playing and non-playing squares of contrasting colors, each square marked with two numbers representing numerical multiplication tables from 1 to 12 which numbers are consecutively listed on vertical columns located at the far right and far left hand sides of the game board;
- 60 game pieces, 30 game pieces for each player; and
- a score card for each player to record numbers from each jumped square landed on until the entire score card is filled up.

BRIEF DESCRIPTION OF THE DRAWINGS

These as well as other features of the present invention will become more apparent upon reference to the drawings wherein:

FIG. 3 is a perspective view of a game score card;

DETAILED DESCRIPTION OF THE INVENTION

Figure 1:
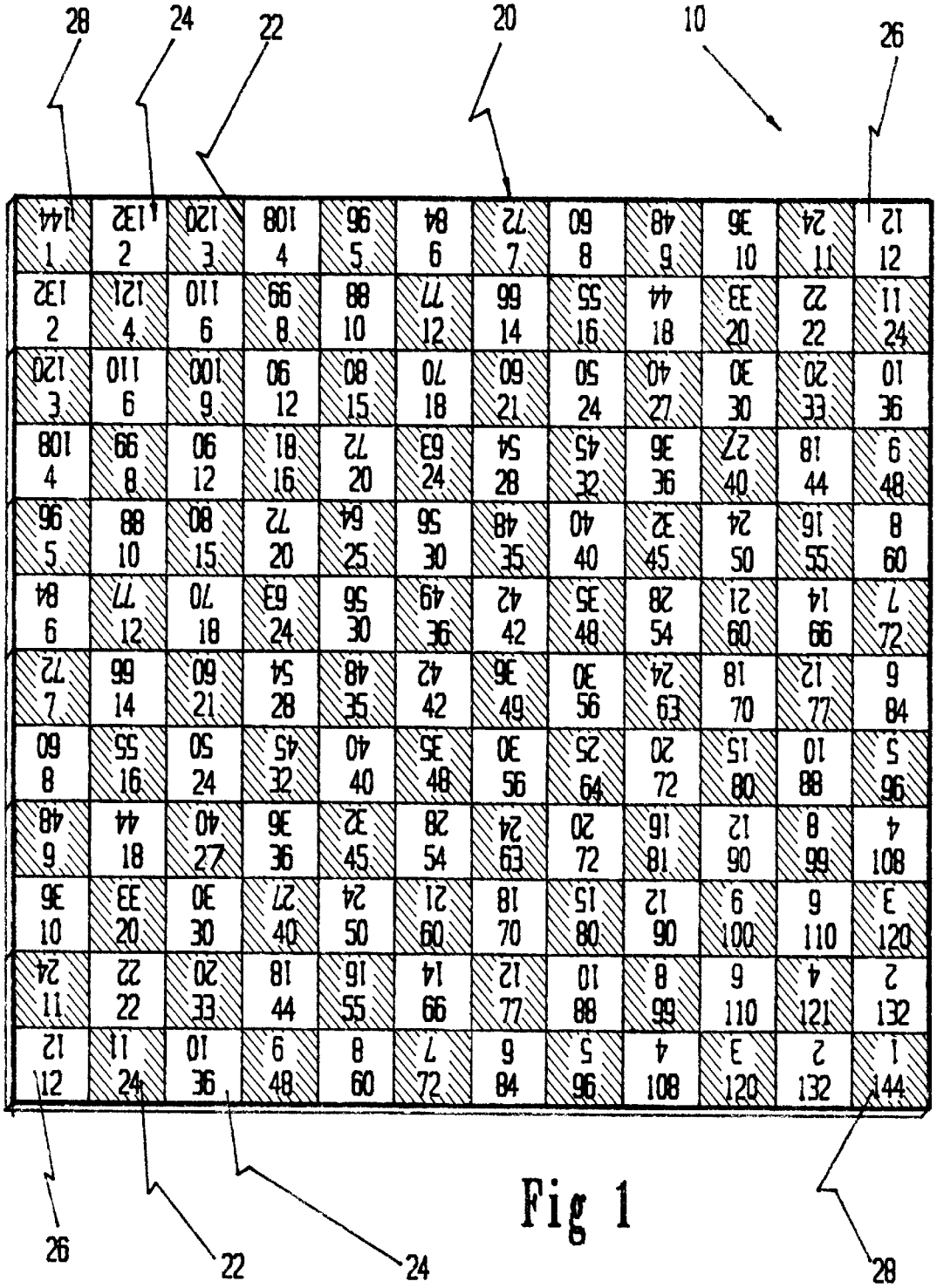
FIG. 1 is a top plan view of the game board.

FIGS. 1, 3, 4 and 5 collectively illustrate the components of the multiplication checker game apparatus 10 of the present invention. The game apparatus 10 includes game board 20 including 144 squares in an alternating checker board configuration; sixty game pieces consisting of two sets of thirty game pieces also referred to herein as checkers 30, 32 including two 12 Piece game pieces 34, 36 and a score card 40 with the numerals recorded on alternating game squares 44 and the adjacent game squares 42 blank.

Game Board 20 is a 12×12 matrix of game squares with the 12/12 game squares 26 and the 1/144 28 game squares serving special roles which will be described later in greater detail.

The game squares 22, 24, each contain two numbers, where the numbers are conformed in such a manner as they face in opposite directions one facing each of the two opposing players.

The game squares 22, 24 are organized in 12 rows and 12 columns with alternating colors defining playing and non-playing game squares 22, 24. The game board 20 is configured like a conventional checker board. The game board 20 consists of light squares 24 and dark squares 22. Only one color of game squares will be used at one time. One color square will be selected as the playing game squares and the other color will be designated as the non-playing game squares.

It is contemplated that the game board 20 can be formed of any substantially rigid material such as cardboard, wood or plastic. The game board 20 may be adapted to fold in a conventional manner at the center thereof for ease in transporting and storing or packaging. The game board 20 may be a painted surface on the game board 20, or alternately may comprise a separately prepared and patterned paper or plastic surface which is affixed to the game board 20. Painting the game board 20 can create a valuable art piece.

Figure 4:
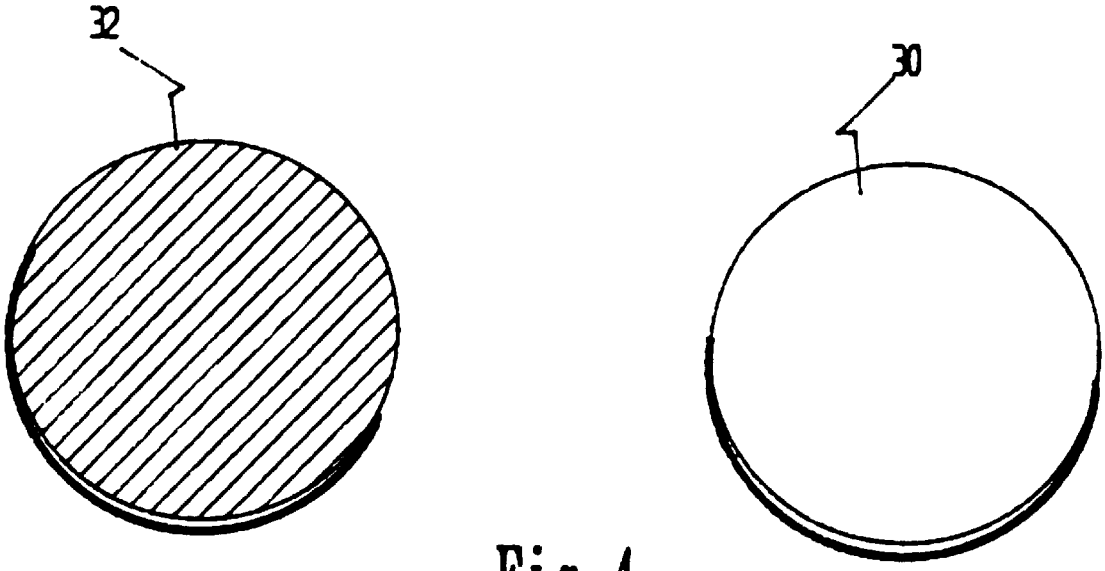
FIG. 4 is a perspective view of two game pieces.
Figure 5:
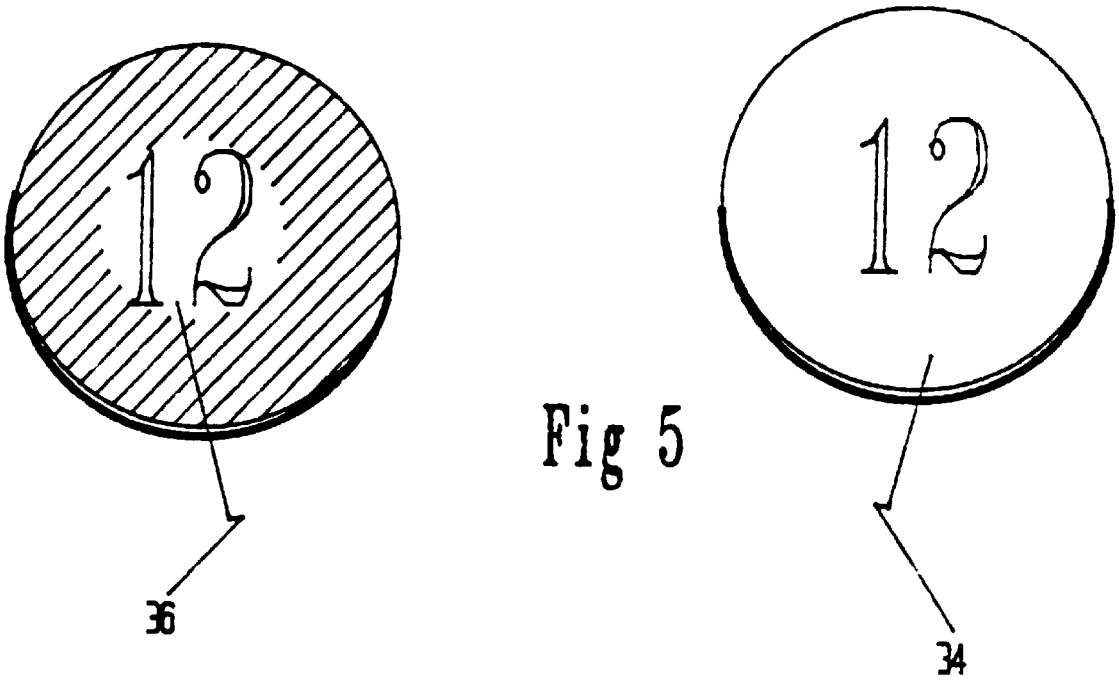
FIG. 5 is a perspective view of two 12 Pieces.

FIG. 4 AND FIG. 5 describe the game pieces, 30, 32, 34, 36. Game Pieces include sixty pieces, thirty pieces of one color and thirty pieces of a second color.

Two game pieces, 34, 36 have the number twelve, one of each color. These game pieces are referred to as 12 Pieces 34, 36.

The game pieces 30, 32, 34, 36 are cylindrical disks or checker type members of any form or fashion, suitably sized and adapted for the game squares 22, 24, 26, 28 of the present invention. The 12 Piece 34, 36, has super powers in the present invention. The game pieces 30, 32, 34, 36 like the game board 20 can be artistically created and serve as a valuable work of art.

FIG. 3 depicts a score card 40 comprised of a 12×12 grid which correlates to the game board 20 with numerals on all the non-playing squares. The playing squares will be filled in during play. The score card 40 can be made of any suitable material including but not limited to paper, card board, plastic or any of the erasable formulations where the same score card can be used repeatedly.

Figure 2:
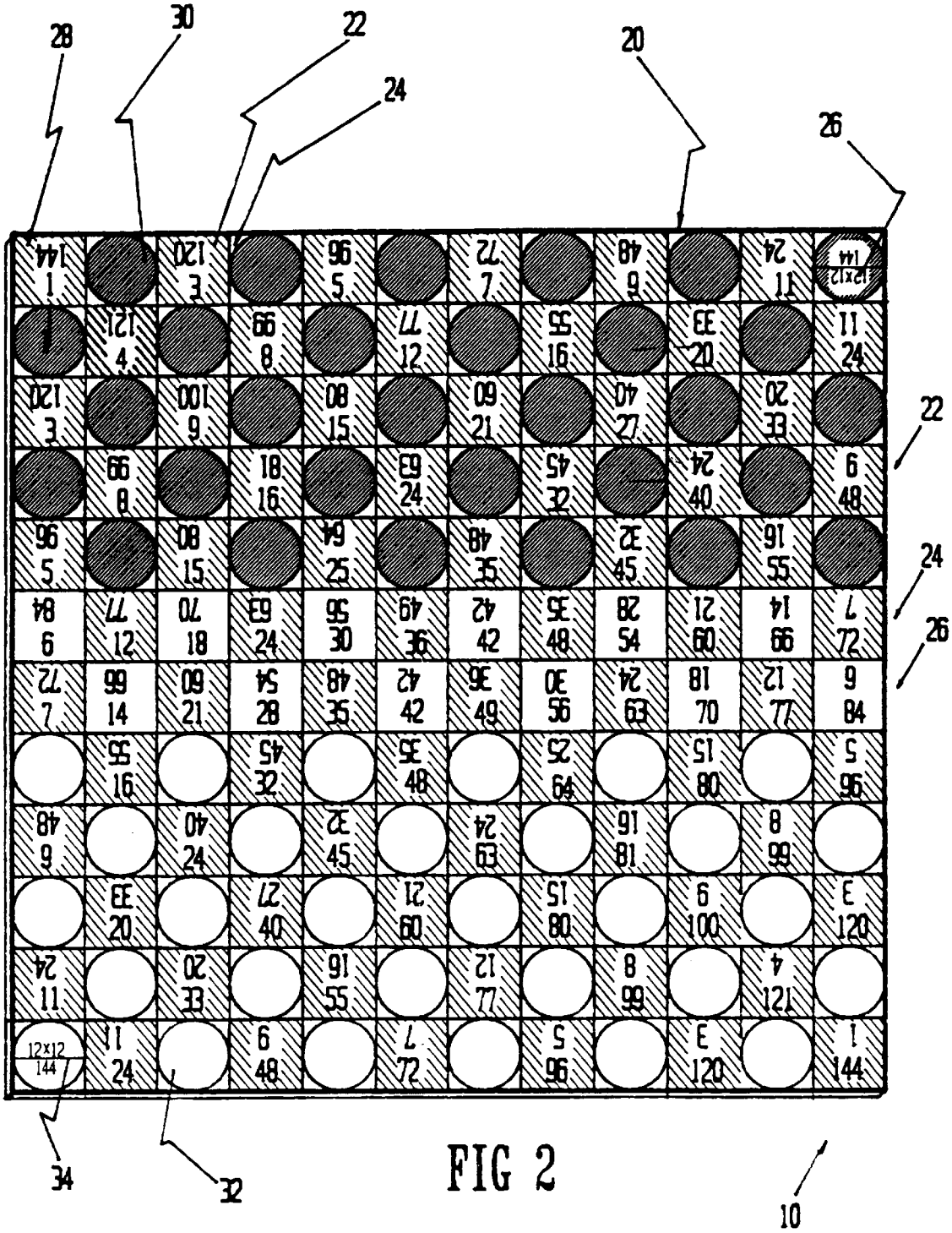
FIG. 2 is a top plan view of the game board with the playing pieces placed thereon in a game starting position in accordance with the invention.

FIG. 2 depicts game apparatus 10 arranged for the start of play. The unnumbered game pieces 30, 32 and 12 Pieces 34, 36 are set on the game board 20 on playing squares. At the beginning of the game players select use of one color of playing squares, thus determining the playing squares for that game.

Play of the game begins with one player moving one of his/her front row game pieces out of that front row in a forward diagonal direction to a contiguous same colored vacant space. Rather than elaborate on all rules regarding movement, directions, jumping and kinging, it should suffice to explain that movement of the game pieces 30, 32, 34, 36 and the rules of play as to jumping, multiple jumps, moving forward unless kinged and getting kinged are the same as the rules for the conventional game of checkers.

Several differences exist however. One is the 12 Piece can move in any direction in a manner similar to a King. If a player's 12 Piece captures the opponents 12/12 or 1/144 playing square that player automatically wins the game. The object of the game is two fold first to eliminate opponents game pieces by jumping them and also to fill in the missing numbers on the score card 40. One must jump an opponents game piece in order to record a score. A player who jumps his opponent's game piece records the number of the playing square on which said player's game piece lands. At the end of the game when all of one player's game pieces are eliminated, the score cards of both players are tallied and the player with the highest score wins.

Figure 6:
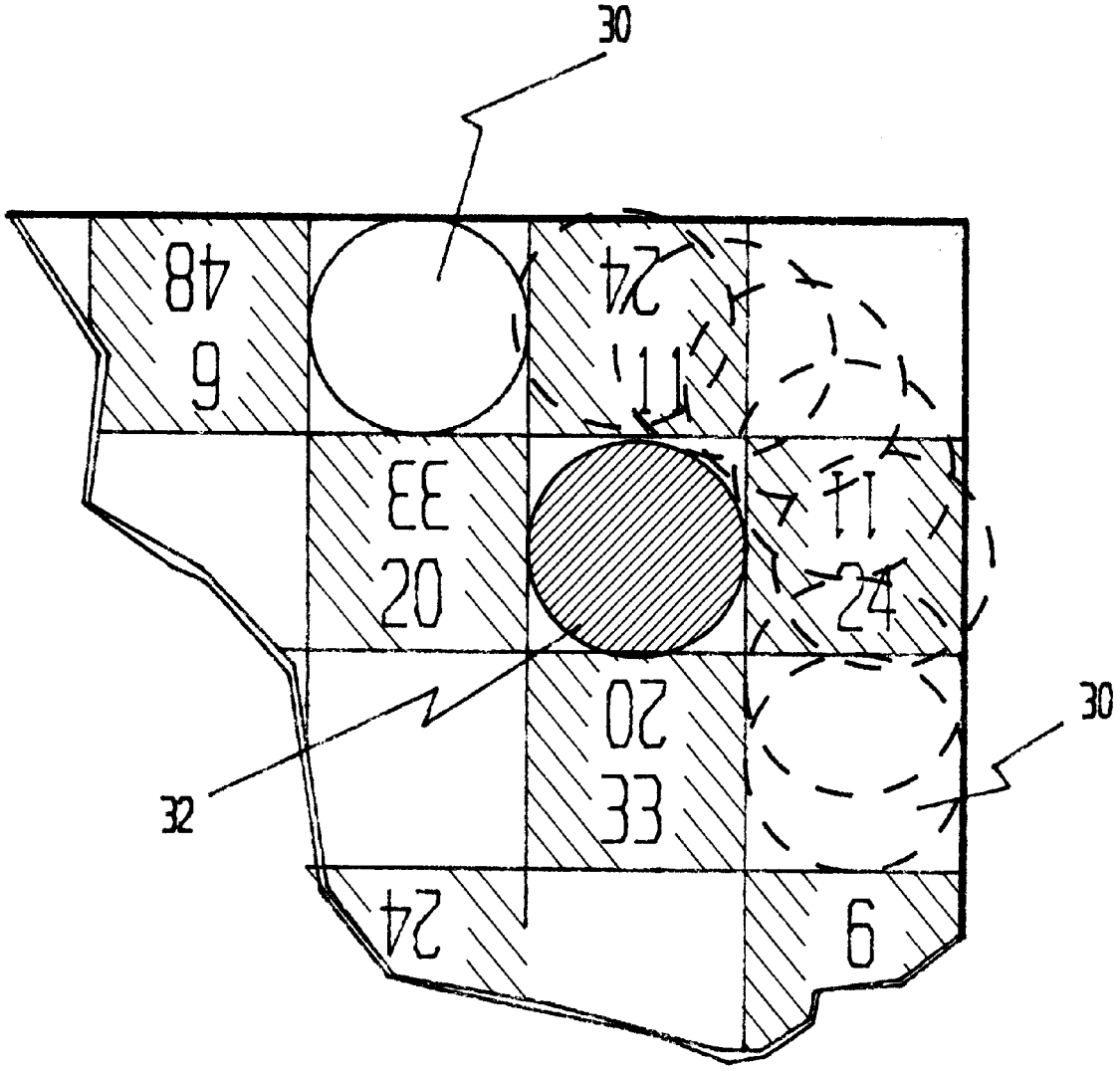
FIG. 6 is a perspective view of the game board during play illustrating a jump being made according to the rules of the invention.

FIG. 6 depicts the jumping of a game piece. As illustrated game piece 30 belonging to one player jumps game piece 32 belonging to the other player. The number of the square on which the jumping player lands, is recorded on the score card. In the event that the numeral is already recorded then the number if divisible by 2 or 3, may be recorded in its component parts ex. 40 divided by 2=20 or 9 divided by 3=3. Then two 20s or up to three 3s respectively can be recorded on the score card if space allows.

Changes and modifications in the specifically described embodiments can be carried out without departing from the scope of the invention which is intended to be limited only by the scope of the appended claims.

What is claimed is:

1. A board game apparatus for play by two players comprising:

a game board divided into 12 rows of 12 alternate playing and non playing squares of contrasting colors, each square marked with two numbers representing numerical multiplication tables from 1 to 12 which numbers are consecutively listed on vertical columns located at the far right and far left hand sides of the game board;

60 game pieces, 30 for each player; and a score card for each player to record numbers from each jumped square landed on until the entire score card is filled up.

2. A board game apparatus according to claim 1 wherein the 60 game pieces include 2 game pieces marked "12", one for each player.

* * * * *